US005400405A

United States Patent [19]

Petroff

[11] Patent Number: 5,400,405

[45] Date of Patent: Mar. 21, 1995

[54] AUDIO IMAGE ENHANCEMENT SYSTEM

[75] Inventor: Michael L. Petroff, Simi Valley, Calif.

[73] Assignee: Harman Electronics, Inc., Northridge, Calif.

[21] Appl. No.: 88,000

[22] Filed: Jul. 2, 1993

[51] Int. Cl.[6] ..... H04S 1/00

[52] U.S. Cl. ..... 381/1

[58] Field of Search ..... 381/1, 287, 63

[56] References Cited

U.S. PATENT DOCUMENTS 4,053,711 10/1977 DeFreitas et al. ..... 381/63

5,263,086 11/1993 Yamazaki ..... 381/1

OTHER PUBLICATIONS

National Semiconductor, AN20, Feb. 1969 "An Application Guide for Operational Amplifiers", p. AN20–3.

*Primary Examiner*—Forester W. Isen

*Attorney, Agent, or Firm*—J. E. McTaggart

[57] ABSTRACT

Stereo processing circuitry is provided for modifying stereo signals so as to enhance the perception of imaging and ambience in non-ideal listening locations and confined environments such as the driver's location in a stereo-equipped vehicle. In a first modified mode, the stereo channels are symmetrically cross-coupled in additive polarity at high frequencies to enhance image localization, and in subtractive polarity over a full audio frequency spectrum to enhance stereo ambience. In a second modified mode, additional cascaded circuitry introduces frequency-selective polarity inversion and asymmetrical cross-coupling to compensate for the closer proximity of one of the loudspeakers to the listener's location, for the direct sound path from the nearer loudspeaker, and for the typical off-axis orientation of the nearer loudspeaker relative to the listener's position. In this second mode, the overall stereo listening effects including channel amplitude balances correction of acoustic polarity, equalization of off-axis loudspeaker frequency response, stereo ambience effect and image realization are optimized for a predetermined listening location. A three-position switching system allows selection of normal stereos the first modified mode or the second modified mode. The signal processing circuitry for implementing the second modified mode may be configured by a selection of modular op-amp filter and signal summing circuit blocks which perform frequency-dependent polarity inversion and, in a preferred embodiment, asymmetrical channel cross-coupling.

24 Claims, 3 Drawing Sheets

FIG. 4
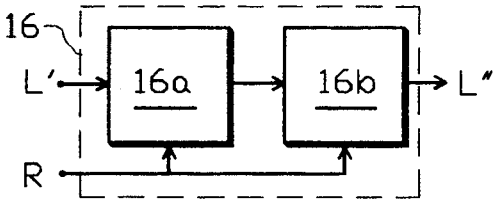
FIG. 5
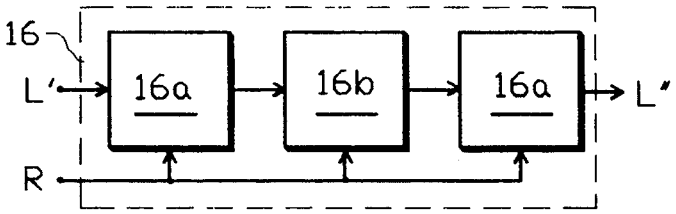
FIG. 6
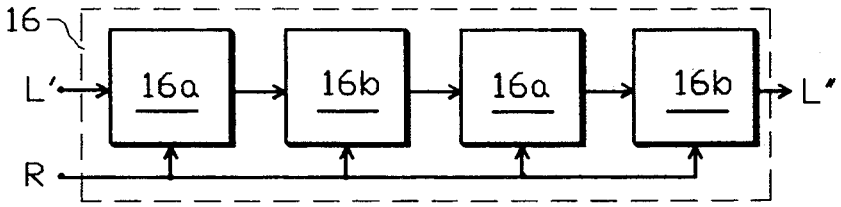
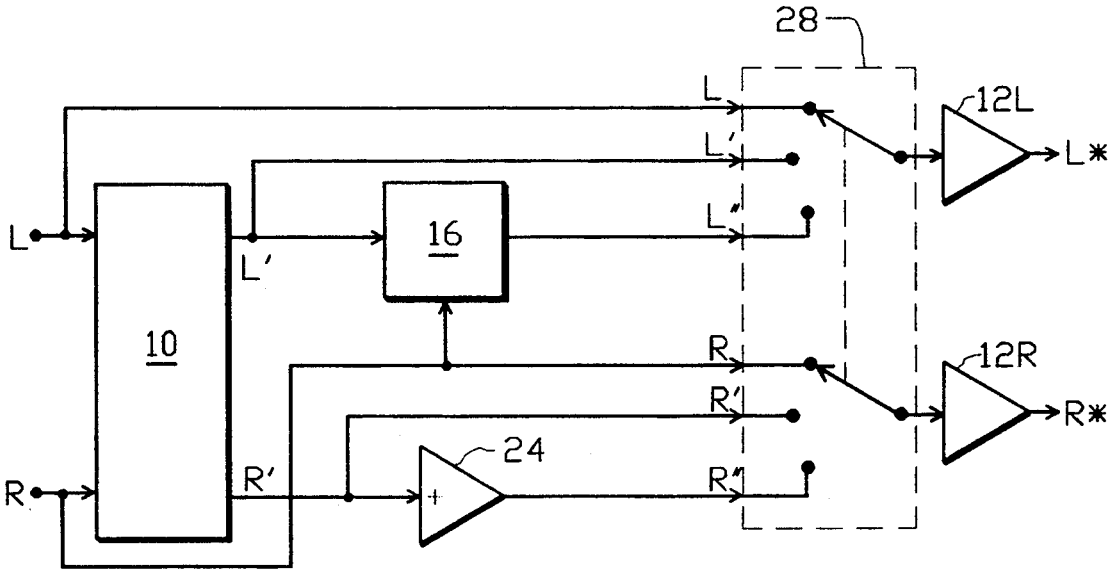
FIG. 7

AUDIO IMAGE ENHANCEMENT SYSTEM

FIELD OF THE INVENTION

The present invention relates to stereophonic audio reproduction and more particularly it relates to audio processing circuitry for enhancing stereo imaging and ambience effects in confined listening environments, such as in vehicles, where compensations are needed for inter-aural amplitude, polarity and frequency response differences, and differences between left and right channel sound ambience as perceived at listening locations which are non-central relative to the stereo loudspeakers.

BACKGROUND OF THE INVENTION

For ideal stereo listening, the two stereo channels should be identical electrically and acoustically, and the stereo loudspeakers should be optimally and symmetrically located in a symmetrical listening room where the listener is located centrally between the two loudspeakers at an optimal distance from the loudspeakers. Under these ideal conditions a listener experiences accurate image localization, i.e. the ability to sense good approximations of each sound source location as originally recorded, perceive the on-axis frequency response of the loudspeakers, and additionally, experience the sensation of sound ambience or spaciousness of the recording environment which is generally much larger than the listening room.

Imaging is a function of the relative amplitudes and phase of the right and left acoustic signals as perceived at each ear. Additionally, the aural mechanism of imaging is frequency dependent, acting predominantly within a mid range of the audio spectrum, e.g. 300 to 1,000 Hz, where the wavelength is equal to or greater than the distance between the listener's ears. At higher frequencies, the short wavelengths can produce confusing multiple inter-aural polarity inversions and therefore only interaural amplitude differences are perceived by the hearing mechanism and contribute to the imaging effect at such frequencies.

There are many situations where it is impossible to realize ideal listening conditions, for example in an automobile where the space is highly restricted; and, even though the loudspeakers can be located symmetrically within the available space, proper imaging is generally possible only at the centerline of the vehicle. Further, in bucket seat automotive arrangements, the centerline listening position is not accessible and both the driver and the passengers suffer the compromise of an unbalanced listening location where the imaging perception is substantially degraded. Adjusting the stereo amplitude balance control of a conventional auto stereo system to favor one of the front seat locations, e.g. the driver's location, can provide some improvement for the driver by balancing the left and right channel amplitudes as perceived, but fails to provide optimal image perception. This failure is due to the (a) difference in L and R sound travel path lengths and resulting polarity inversions in the critical 300 to 1,000 Hz region, (b) the severely unbalanced off-axis listening angles relative to each loudspeaker resulting in an unbalance of the perceived high frequency levels from the loudspeakers and (c) the greater degree of ambient sound, i.e. reverberant sound fields, produced by the further loudspeaker relative to the closer loudspeaker at the described asymmetrical listening locations.

It is known that cross-mixing the two stereo channels together in additive polarity will reduce the stereo separation effect perceived by a listener: carried to the limit, full L+R addition in both channels reduces stereophonic sound to monophonic. It is also known that cross-mixing in subtractive polarity, by decreasing the common-mode signal content in each channel, can create a perception of "musical stage expansion" and enhance ambient sound reproduction.

It is known that, for particular non-ideal listening locations, subjective improvements in the imaging and/or ambience of sound reproduction may be realized through signal processing of one or both of the stereo channels. Stereo modification systems have been proposed and utilized which alter the right and left stereo source signals in various ways; however such systems fail to compensate for each of the previously described deficiencies and signal errors which occur under non-ideal listening conditions, and, in cases where digital processing is required, also tend to be substantially more complex and costly to implement relative to the present invention.

RELATED PRIOR ART

In U.S. Pat. No. 4,817,162, Kihara discloses apparatus for correcting the binaural correlation coefficient of stereo audio signals by utilizing phase shifter type circuits in at least one channel.

In U.S. Pat. No. 5,033,092, Sadale addresses improvement of sound localization in automobiles by introducing phase shifts of opposite polarity in the two channels over selected frequency ranges, utilizing finite impulse response digital filters.

In U.S. Pat. No. 5,119,420, Kato et al address improvement of localization at a non-equidistant listening location and/or in a narrow space by introducing delay means in at least one of the stereo channels utilizing microcomputer and digital memory means.

OBJECTS OF THE INVENTION

It is a primary object of the present invention to provide an electronic stereo audio processing system which improves the reproduction of stereophonic sound as perceived in a confined location and where the listener is located outside the optimal listening region substantially equidistant from the stereo loudspeakers, e.g. when the listener is seated at either side in a vehicle.

It is another object to provide processing circuitry which operates in a first mode to symmetrically modify high frequency components of the stereo signals in a manner to improve the imaging effect and to modify the stereo signals over a full frequency range in a manner to enhance the perceived sound ambience.

It is a further object to provide stereo processing circuitry which operates in a second mode to modify the signal in a non-symmetrical manner, i.e. predominantly in a selected one of the two channels, in order to optimize imaging as perceived at a nonideal listening location which is substantially closer to one of the loudspeakers than to the other.

It is a still further object to enable the second stereo mode to compensate for broadband stereo amplitude unbalance, stereo frequency response differences, particularly degradation of perceived high frequency response related to unfavorable loudspeaker orientation, and the above-described inequality in ambient sound fields between the left and right channels as perceived at the above nonideal listening location.

It is yet another object to enable selection of operation in any of three modes: the above-described first mode, the above-described second mode or an unmodified stereo mode.

It is an additional object that the processing system circuitry is realizable through the use of relatively simple and cost-effective analog circuitry.

SUMMARY OF THE INVENTION

The present invention provides stereo enhancement modification in two adjustable modes: (1) a symmetrical mode in which the imaging effect is intensified through high frequency positive polarity cross-coupling, and the sound ambience effect is increased through broadband negative-polarity cross-coupling, and (2) an asymmetrical mode in which such imaging and ambience enhancements are intensified through mid-band polarity compensation, broadband amplitude rebalancing, off-axis frequency response difference equalization and ambient sound field difference compensation, each of which are targeted for a common asymmetrical listening location such as the driver's location in a vehicle. A three-position switching system allows selection of normal stereo, enhanced mode (1) or enhanced mode (2).

BRIEF DESCRIPTION OF THE DRAWINGS

The above and further objects, features and advantages of the present invention will be more fully understood from the following description taken with the accompanying drawings in which:

FIGS. 4, 5 and 6 are exemplary block diagrams of two- three- and four-stage processing circuits utilizing cascaded circuit blocks of FIGS. 3A and 3B for forming the left channel signal processing circuit block of FIG. 2.

FIG. 7 is a simplified schematic diagram of switch selection circuitry incorporated with circuitry of FIG. 2.

DETAILED DESCRIPTION

Figure 1:
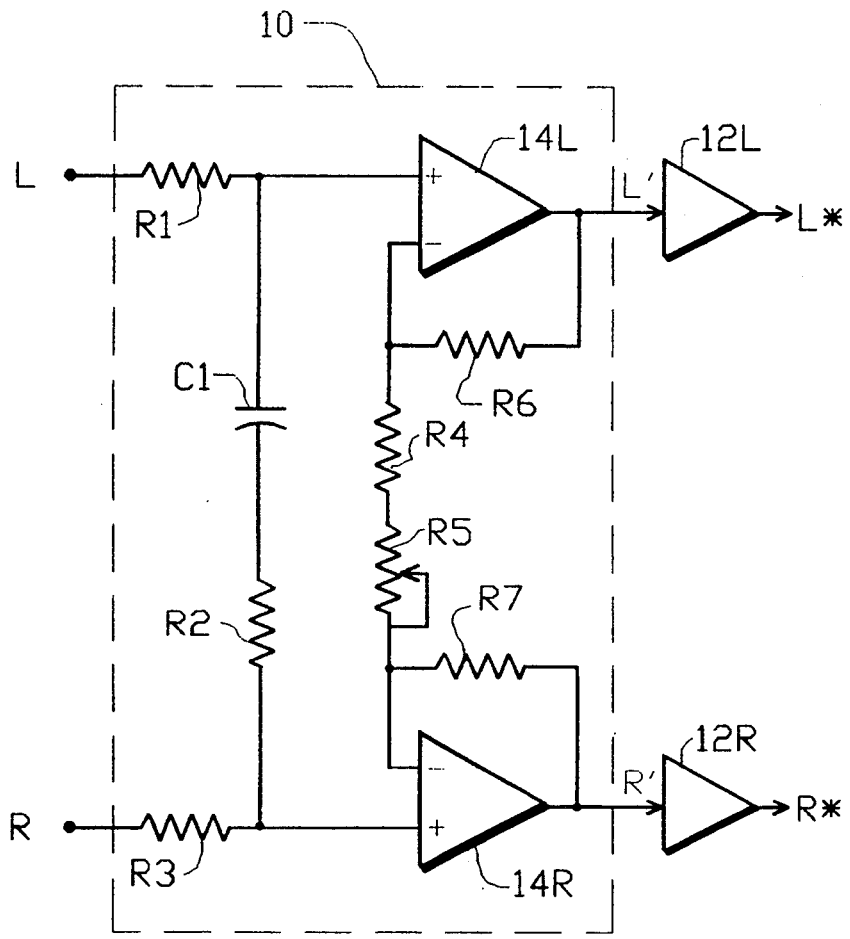
FIG. 1 is a schematic diagram of a dual-function cross-coupling circuit for a pair of stereo channels in the present invention, providing high frequency positive polarity cross-coupling and broadband negative polarity cross-coupling.

FIG. 1 is a simplified schematic of a dual-function cross-coupling circuit 10 receiving an input stereo signal consisting of left channel input signal L and right channel input signal R, and delivering modified stereo signals L′ and R′ to the inputs of stereo power output stages 12L and 12R which provide stereo output signals, L* and R*, typically applied to a corresponding pair of stereo loudspeakers mounted at typically separated locations; for example, in a vehicle, symmetrically adjacent to each side of the seating region.

In the input circuit, resistor R1, capacitor C1, resistor R2 and resistor R3 are connected in series between the input terminals receiving signals L and R. At low frequencies where the reactance of C1 is high compared to the resistance of R2, signals L and R drive the non-inverting inputs of op-amps 14L and 14R through resistors R1 and R3 respectively with minimal stereo signal cross-coupling. At high frequencies, where the reactance of Cl becomes low compared to the resistance of R2, positive polarity cross-coupling is introduced between the left and right channels as determined by the values of R1, R2 and R3. Typically resistors R1 and R3 are made equal in value so that the high frequency cross-coupling is symmetrical channel-to-channel.

Broadband negative polarity cross-coupling between the stereo channels is introduced by the bilateral circuit branch having resistors R4 and R5 connected in series between the inverting inputs of op-amps 14L and 14R and interacting with feedback resistors R6 and R7. Variable resistor R5 may be provided either as an internal adjustment or as an external user control for varying the amount of negative polarity cross-coupling. Alternatively, the variable resistor R5 may be implemented as a photo-resistor opto-coupled to a current-controlled light source. As another alternative, a predetermined amount of cross-coupling could be provided by replacing R4 and R5 with a single fixed resistor.

The high frequency positive polarity cross-coupling introduced by C1 and R2 acts to increase the common-mode content of the two channels in the high frequency range and thus reduces the stereo separation at high frequencies, in effect converging to a degree the high frequency imaging toward a central perceived source point for enhanced localization, while the broadband negative-polarity cross-coupling introduced by R4 and R5 acts to increase the perceived stereo ambience by increasing the non-common-mode reverberant signal content in each channel.

The processing system of FIG. 1 can be made to operate in a symmetrical mode by making R1 equal to R3 and R6 equal to R7 so that both the high frequency image enhancement and broadband ambience enhancement affect both channels symmetrically. This mode can benefit a wide variety of listening locations, e.g. in a vehicle, since the center, driver's side and passenger's side are affected equally.

Alternatively, the system of FIG. 1 can be made to made to operate in an asymmetrical mode with regard to the high frequency cross-coupling by making R1 and R3 unequal, and/or with regard to the broadband cross-coupling by making the resistance values of R6 and R7 unequal; e.g. making R6 higher in resistance than R7 increases the common mode signal content in the left channel, thereby increasing the ambience perception at the driver's location in an automobile.

As a matter of circuit design choice, broadband cross-coupling could be implemented by providing two separate unilateral cross-coupling branches in the circuitry (L to R and R to L) as an alternative to the single bilateral cross-coupling circuit branch shown.

Figure 2:
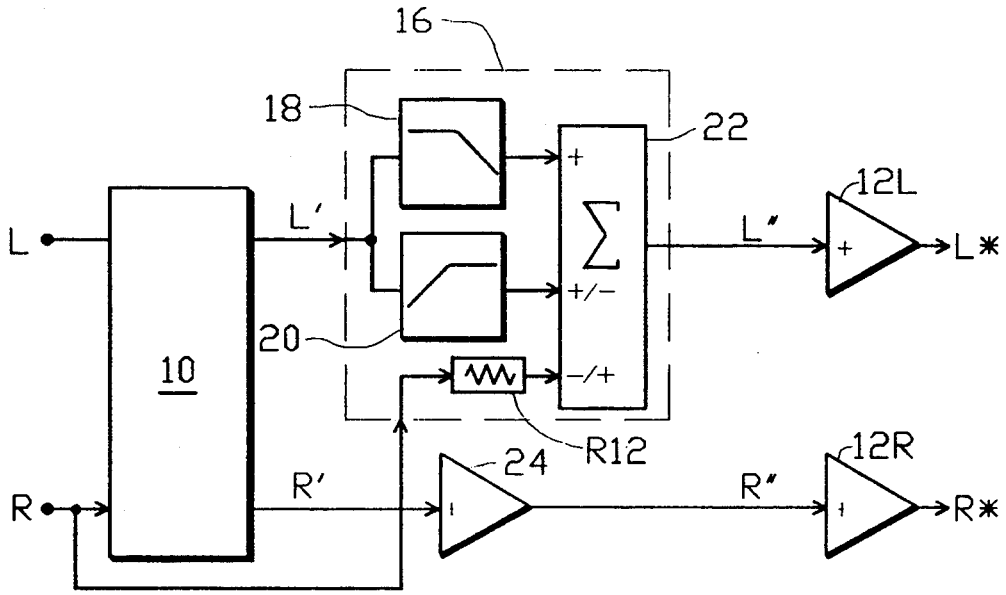
FIG. 2 is a block diagram of a signal processing system containing the elements of FIG. 1 incorporated with cascaded left channel signal processing circuitry for frequency-selective polarity inversion and asymmetrical channel cross-coupling.

FIG. 2 is a block diagram which includes the elements of FIG. 1 in an input processor 10, made to operate in the above described symmetrical mode, supplying the first processed signal pair L′ and R′ as input to additional asymmetric processing circuitry which in turn drives the output amplifiers 12L and 12R.

Block 16 indicates in general form the desired circuitry functions of frequency-selective polarity inversion and asymmetrical cross-coupling, applied to the left channel. The symmetrically processed left channel signal L' from unit 10 is applied to a low pass filter 18 and a high pass filter 20, the outputs of which are applied to first and second inputs respectively of a summing circuit 22 which also receives the R input signal at a third input. The first input is non-inverting, while the second and third inputs are differential (i.e. inverting and non-inverting respectively or non-inverting and inverting respectively) so as to reverse the polarity of the cross-coupled R signal relative to that of the high frequency portion of the left channel signal from high pass filter 20, thus increasing the -R prominence in the left channel. Summing circuit 22 is typically made to provide effectively equal gain at the first two inputs, or to slightly boost the high frequency portion at the second input, while the effective gain at the third input is made to be relatively low, typically by the insertion of attenuation as indicated symbolically by attenuator 12 which may be implemented as a resistive voltage divider or other signal reduction means to introduce the R signal in a predetermined optimal proportion.

It is known that perceived audio fidelity does not require the low and high frequency portions of the audio spectrum to be kept in the same polarity; in evidence of this many high quality speaker crossover networks are designed such that loudspeakers in different frequency bands, i.e. woofers, midrange units and tweeters, operate electrically in opposite polarity.

The output of summing circuit 22 is delivered as a final processed left channel signal L" to the left output amplifier 12L, which provides the left channel output signal L*.

In the right channel, the symmetrically processed signal R' from unit 10 is processed through amplifier 24 and delivered as a final processed right signal R" to the right channel output amplifier 12R which provides the right channel output signal R*.

Amplifier 24 is preferably provided with adjustment means for setting the gain of the right channel as required to balance the two channels in amplitude as perceived at the targeted asymmetrical listening location.

FIGS. 3A, 3B, 3C and 3D show differing blocks of circuitry configurations for providing the functions of frequency-selective polarity inversion and asymmetrical cross-coupling. The function of summing circuit 22 in FIG. 2 is performed by op-amp 26 and resistors R8–R11.

Figure 3A:
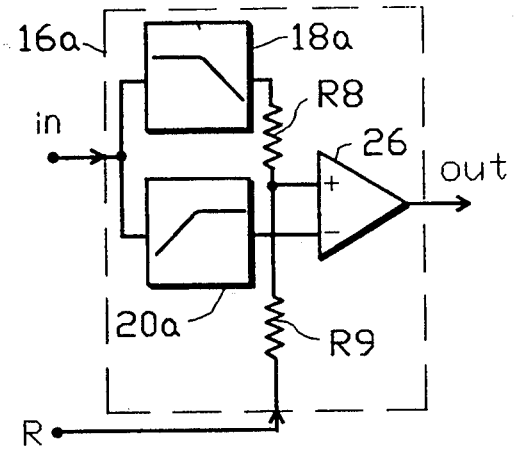
FIGS. 3A–3D are circuit blocks for forming the left channel signal processing circuit block of FIG. 2.

FIG. 3A shows a circuit which may be utilized as a single stage to provide the function of block 16 in FIG. 2, or which may be utilized as the first stage in a cascaded series of blocks chosen from FIGS. 3A–3D. The low frequency signal portion from low pass filter **18*a* and the R signal are summed in a predetermined ratio without inversion, while the high frequency signal portion from high pass filter 20*a*** is inverted, thus establishing the desired L-R polarity relationship in the high frequency range.

Filters **18*a* and 20*a* may be of the first order RC type, however higher order filters could be used to steepen the rolloff slopes and thus alter the transfer function characteristics of the frequency-selective polarity inversion signal process. Filters 18*a* and 20*a*** are typically designed with roll-offs at approximately 400 Hz.

A preferred embodiment of this invention utilizes two stages in cascade, with each stage having first order filters.

Figure 3B:
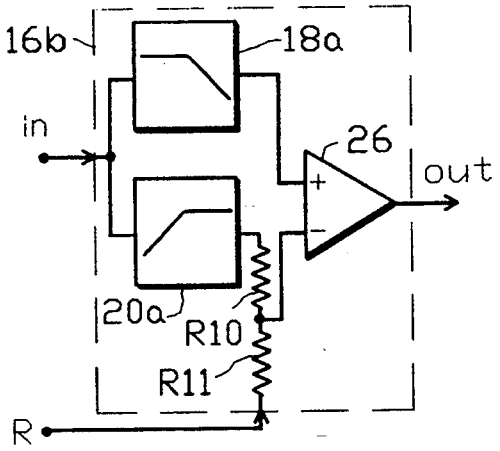
Figure 3C:
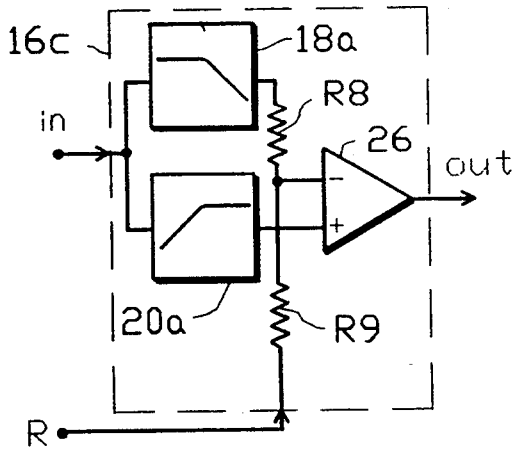
Figure 3D:
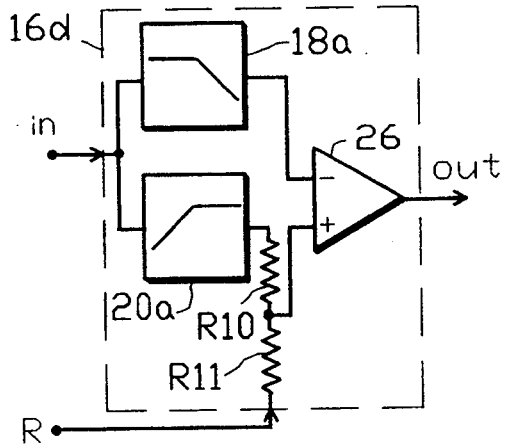

In FIG. 3B, block **16*b* differs from block 16*a* (FIG. 3A) in that the R signal becomes inverted in polarity at the output, thus block 16*b* requires an input signal having inverted polarity, so as to preserve the required polarity opposition between the high frequency portion of the main output signal and the high frequency portion of the R signal being introduced. Blocks 16*c* (FIG. 3C) and 16d (FIG. 3D) differ from blocks 16*a* and 16*b* (FIG. 1) respectively only in the reversed polarity of the connections at the inputs of op-amps 26**. It is assumed that predetermined gain and summing ratios will be established in the selection of component values in the detailed circuit design of each different block.

Analysis will show that block **16*a* (FIG. 3A) is the only one of the group 16*a*–16*d* which, used alone as a single stage processor (block 16, FIG. 2), will provide the desired inverted polarity relationship between the high frequency filtered signal component and the high frequency portion of the cross-coupled R signal, while maintaining the polarity of the low frequency output non-inverted relative to the low frequency input signals. Various multi-stage processors may be formed by cascading combinations of blocks 16*a*–16*d*, however the stages must be correctly chosen so that their combination provides the previously stated polarity relationships, i.e. (a) in each stage the polarity of the high frequency portion of the incoming signal is to be opposite that of the R signal being introduced in that stage, and (b) the low frequency signal at the output of the processor 16** is to be kept non-inverted in polarity relative to the low frequency components of the L' and R' input signals (refer to FIG. 2).

In a preferred two-stage embodiment of processor 16 (FIG. 2) utilizing blocks **16*a* and 16*b* (FIGS. 3A, 3B) cascaded in AB sequence, an incoming signal component at 400 Hz will be inverted in polarity at the output of processor 16, having shifted −90 degrees in each stage for a total of −180 degrees; this corrects for the left speaker-to-ear path being shorter than the right speaker-to-ear path on the order of 16", i.e. approximately one-half wavelength at 400 Hz at typical sound velocity. Blocks 16*a* and 16*b*** each preserve the original polarity of the low frequency portion of the signal. In addition, the extreme high frequency portion retains its original polarity, having been inverted twice, once in each stage; and in accordance with the above-stated requirements, the cross-coupled R signal component is inverted, i.e. negative in polarity, relative to the high frequency portion at each stage.

In the following list of examples of single-stage and multi-stage processors which can be formed from blocks **16*a*–16*d* to properly perform the functions of the preferred embodiments as shown in block 16 (FIG. 2) in accordance with the above-stated requirements, each functional processor combination is indicated as a stage-by-stage sequence where A, B, C and D designate blocks 16*a*, 16*b*, 16*c* and 16*d*** respectively:

One stage: A
Two stage: AB; CC
Three stage: ABA; ADD; CAD; CCA
Four stage: ABAB; ABCC; ADBC; ADDB; CABC; CADB; CCAB; CCCC It will be noted in these examples that at the processor output, relative to the low frequency portion of the signal, the high frequency portion will be non-inverted when the number of stages is even, e.g. 2 or 4 stages, but will be inverted when the number of stages is odd, e.g. 1 or 3 stages.

As a side effect in the foregoing processors, -R components may be cross-coupled into the left channel in the low frequency portion of the signal: this is generally negligible in subjective effect.

Figure 3E:
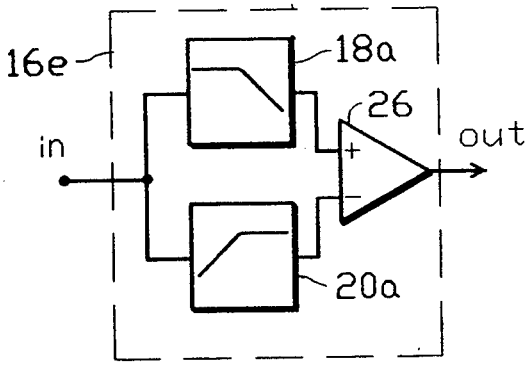
FIGS. 3E and 3F are circuit blocks for frequency-selective polarity inversion which may be utilized optionally in forming left channel signal processing block of FIG. 2.
Figure 3F:
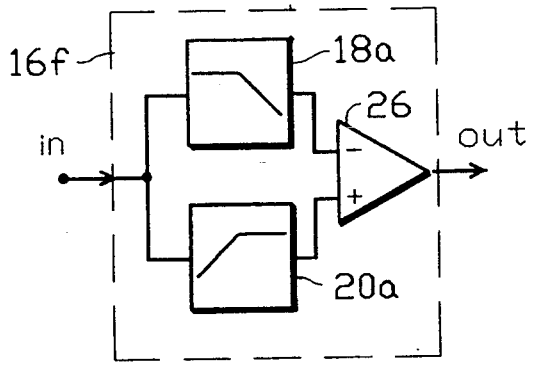

In FIGS. 3E and 3F, block diagrams 16*e* and 16*f* represent frequency-selective polarity inversion blocks for processing one channel without introducing any cross-coupling from the other channel. A low pass filter 18*a* and a high pass filter 20*a*, having roll-off frequencies in the order of 400 Hz, separate the incoming signal into a low frequency portion and a high frequency portion; these two portions are then recombined so as to be oppositely polarized at the output. In FIG. 3E, block 16*e* inverts the high frequency portion of the signal, while in FIG. 3F, block 16*f* inverts the low frequency portion.

Block 16*e* may be utilized as a single stage processor, or a combination of blocks 16*e* and 16*f* may be cascaded to form a processor which introduces frequency-selective polarity inversion in the left channel in the manner of block 16 (FIG. 2) but without introducing any R signal.

Blocks 16*e* and 16*f* can also be utilized in cascaded combination with blocks selected from the group 16*a*–16*d* to form left channel processor configurations as alternatives to those previously described.

In a typical asymmetrical listening location such as the driver's location in an automobile, the listener is severely offset from the axis of the closer loudspeaker and thus a substantial degradation of high frequency response is perceived due the orientation and directivity pattern of the loudspeaker. The processors of FIGS. 3A–3F can be readily made to perform the additional function of high frequency equalization in the left channel signal processing path by providing increased gain in a high frequency branch of the path, i.e. at the second input of summing circuit 22 in FIG. 2, relative to the low frequency branch, i.e. at the first input of summing circuit 22. Such equalization, introduced in one or more of the cascaded stages, is proportioned to approximate balanced frequency equalization as perceived at the asymmetrical listening location. Of course, such compensation could be provided by alternative means such as providing suitable high-frequency-boosting circuitry interposed at some point in the A-channel signal path; however the frequency-selective function already available in modules 16*a*–16*f* of the present invention eliminates the need for such separate equalization circuitry.

FIGS. 4, 5 and 6 show block diagrams of processor 16 as formed from combinations AB, ABA and ABAB respectively. The combination AB in FIG. 4 represents the aforementioned preferred embodiment.

FIG. 7 is a block diagram of a three-position switching unit 28 in an overall stereo enhancement system of the present invention incorporating the elements of FIG. 2.

Switching unit 28 is made to be user operable and may be implemented in the form of an electronic switch actuated by a control signal to select any one of three operating modes by switching the inputs of output amplifiers 12L and 12R to one of three pairs of input signals: unmodified signals L and R, symmetrically modified signals L′ and R′, and asymmetrically modified signals L″ and R″. Thus in a vehicular stereo system a listener can select a first mode providing normal stereo operation, a second mode in which ambience and imaging are enhanced symmetrically for general coverage within the vehicle, or a third mode in which ambience and imaging are particularly enhanced for a target asymmetrical listening location, e.g. that of the driver.

A stereo enhancement system in accordance with the principles of the present invention could be readily adapted to direct the asymmetrical compensation effects of the third mode to a right side asymmetrical listening location for optimum listening enhancement for the driver of a right hand drive vehicle or a passenger seated to the right in a left hand drive vehicle: such capability would typically be made selectable via a user-operable switch.

This invention may be embodied and practiced in other specific forms, e.g. in analog or functionally equivalent digital implementation, without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. Stereophonic audio processing circuitry for modifying an input stereo signal pair, consisting of an A-channel input signal and a B-channel input signal, in a manner to provide a processed stereo signal pair for producing via stereo output amplifiers and loudspeakers a modified acoustic field providing ambience enhancement and image enhancement, said circuitry comprising:

an input processor, receiving the input stereo signal pair, comprising:

a high-pass cross-coupling circuit having a frequency-dependent branch providing high frequency channel-to-channel cross-coupling in additive polarity and in a predetermined amount; and a broad-band cross-coupling circuit, having at least one broad-band cross-coupled signal path providing broad-band channel-to-channel cross-coupling in subtractive polarity;

said input processor being made to provide as output a first modified stereo signal pair, consisting of a first modified A-channel signal and a first modified B-channel signals wherein additive cross-coupling is introduced in a high frequency range for imaging enhancement, and subtractive cross-coupling is introduced over a broad frequency range for enhanced recorded sound ambient information.

2. The stereophonic audio processing circuitry as defined in claim 1 wherein said input processor is configured symmetrically so as to cause the cross-coupling provided by said high-pass cross-coupling circuit and said broad-band cross-coupling circuit to be symmetrical with regard to each of the two channels.

3. The stereophonic audio processing circuitry as defined in claim 1 wherein said input processor is configured in a manner to cause the cross-coupling provided by said broad-band cross-coupling circuit to be asymmetrical with regard to each of the two channels, whereby compensation is provided for enhancement of ambience as perceived at an asymmetrical listening location.

4. The stereophonic audio processing circuitry as defined in claim 2 wherein said input processor further comprises:

first and second op-amps (operational amplifiers) each having an inverting input, a non-inverting input which receives, through a corresponding series-connected resistor, a corresponding one of the input stereo signal pair, each of said op-amps having an output connected to the inverting input via a corresponding feedback resistor;

a resistor and a capacitor, connected in series between the non-inverting inputs of said op-amps, and providing a predetermined high pass filter transfer function therein, thus constituting said high-pass cross-coupling circuit; and a resistive circuit branch connected between the inverting inputs of said op-amps, constituting said broadband cross-coupling circuit.

5. The stereophonic audio processing circuitry as defined in claim 4 wherein said resistive circuit branch is made to have a variable resistance value so as to provide adjustment means for regulating broadband cross-coupling.

6. The stereophonic audio processing circuitry as defined in claim 2 further comprising an A-channel processor which receives as a first input the first modified A-channel signal from said input processor, and, as a second input, the B-channel input signal, and which provides as output the second modified A-channel signal having a low frequency portion and a high frequency portion, and a predetermined proportion of cross-coupled B-channel signal, the high frequency portion being inverted in polarity relative to a high frequency portion of the cross-coupled B-channel signal.

7. The stereophonic audio processing circuitry as defined in claim 6 wherein said A-channel processor comprises:

a low pass filter receiving as input said first modified A-channel signal and providing as output a low frequency audio signal;

a high pass filter receiving as input said first modified A-channel signal and providing as output a high frequency audio signal;

summing means receiving at a first input the low frequency audio signal, at a second input the high frequency audio signal and at a third input the B-channel input signal, said summing means providing an output signal constituting the second modified A-channel signal and representing a combination of the signals at the first, second and third inputs in predetermined proportions and wherein high frequency output signal components corresponding to the signals received at the second and third inputs respectively are caused to be inverted in polarity relative to each other.

8. The stereophonic audio processing circuitry as defined in claim 7 wherein said summing means comprises an op-amp (operational amplifier) having a non-inverting input receiving the low frequency audio signal through a first ratio resistor and receiving the B-channel input signal through a second ratio resistor, an inverting input receiving the high frequency audio signal, and an output delivering the output signal.

9. The stereophonic audio processing circuitry as defined in claim 6 wherein said A-channel processor comprises:

a first low pass filter receiving as input the first modified A-channel signal and providing as output a first low frequency audio signal;

a first high pass filter receiving as input the first modified A-channel signal and providing as output a first high frequency audio signal;

a first op-amp having an inverting input receiving the first high frequency audio signal, a non-inverting input receiving the first low frequency audio signal through a first ratio resistor and receiving the B-channel input signal through a second ratio resistor, and an output constituting a source of an intermediate modified signal;

a second low pass filter receiving as input the intermediate modified signal and providing as output a second low frequency audio signal;

a second high pass filter receiving as input the intermediate modified signal and providing as output a second high frequency audio signal;

a second op-amp having a non-inverting input receiving the second low frequency audio signal, an inverting input receiving the second high frequency audio signal through a third ratio resistor and receiving the B-channel input signal through a fourth ratio resistor, and an output constituting a source of the second modified A-channel output signal.

10. The stereophonic audio processing circuitry as defined in claim 6 wherein said A-channel processor comprises a plurality of cascaded processing modules receiving the first modified A-channel signal as input and supplying the second modified signal as output, each of said modules comprising:

a high pass filter;

a low pass filter;

an op-amp; and a pair of ratio resistors, of which one is connected to a source of the B-channel input signal;

said high pass filter, low pass filter, op-amp and ratio resistors being interconnected respectively in each module in a manner to transmit the modified A-channel signal along the signal path, to progressively further modify the signal in said modules by summing therewith a predetermined proportion of cross-fed B-channel signal, and to provide from said modules respectively a modified output signal wherein, at high frequencies, the A-channel signal is caused to be in polarity opposition to the cross-fed B channel signal.

11. The stereophonic audio processing circuitry as defined in claim 10 further comprising at least one frequency-sensitive polarity-inversion module, interposed in the signal path, between two of said processing modules, said polarity-inversion module comprising:

an op-amp having an output supplying a signal into a downstream sector of the signal path, and a pair of differential inputs;

a high pass filter connected between a source of an input signal received from an upstream sector of the signal path and a first one of the differential inputs; and a low pass filter connected between the source of the input signal and a second one of the differential inputs;

whereby said polarity-inversion module provides an output signal wherein a high frequency portion thereof is inverted in polarity relative to a low frequency portion thereof.

12. The stereophonic audio processing circuitry as defined in claim 6 further comprising a variable-gain non-inverting wideband audio amplifier receiving as input the first modified B-channel signal and supplying as output a second modified B-channel signal, thus constituting a B-channel signal processor.

13. The stereophonic audio processing circuitry as defined in claim 7 wherein said summing means is made to have higher gain at the second input than at the first inputs thus providing A-channel high-frequency-boost equalization;

whereby compensation is provided to remedy reduced high frequency response in the A-channel as perceived at an asymmetrical listening location which is closer to the A-channel loudspeaker than to a corresponding B-channel loudspeaker, the reduced high frequency response being due to the listening location being severely off-axis relative to the A-channel loudspeaker.

14. The stereophonic audio processing circuitry as defined in claim 6 further comprising signal switching means for selecting a stereo drive signal pair and thereby driving the output amplifiers, from the following group: (1) the input stereo signal pair, (2) the first modified stereo signal pair and (3) a second modified stereo signal pair consisting of the second modified A-channel signal and the second modified B-channel signal;

whereby selection of signal pair (2) introduces symmetrical additive cross-coupling in a high frequency region for increasing perceived stereo imaging and symmetrical subtractive cross-coupling over a full frequency range for enhancing ambience effect, and selection of signal pair (3) introduces asymmetrical and frequency-dependent polarity inversion for further enhancing stereo imaging and ambience effect as perceived at off-center and off-speaker-axis listening locations.

15. The stereophonic audio processing circuitry as defined in claim 1 wherein the A-channel input signal constitutes a left channel input signal, and the B-channel input signal constitutes a right channel input signal.

16. The stereophonic audio processing circuitry as defined in claim 1 wherein the A-channel input signal constitutes a right channel input signal, and the B-channel input signal constitutes a left channel input signal.

17. Stereophonic audio processing circuitry, in a stereo system operating with an A-channel signal and a B-channel signal, for modifying the A-channel signal, comprising;

a low pass filter receiving as input the A-channel signal and providing as output a low frequency audio signal;

a high pass filter receiving as input the A-channel signal and providing as output a high frequency audio signal; and summing means receiving at a first input the high frequency audio signal, at a second input the low frequency audio signal and at a third input an attenuated replica of the B-channel input signal, said summing means providing an output constituting the modified A-channel signal consisting of a summation of the signals received at the first, second and third inputs in predetermined proportions, wherein high frequency output components deriving from the second input are made to be opposite in polarity to high frequency components deriving from the third input;

whereby, through frequency-selective polarity-inversion and asymmetrical cross-coupling, the modified A-channel signal is caused to include a low frequency audio component, a high frequency audio component and an attenuated cross-coupled B-channel signal component of predetermined proportion having in a high frequency range thereof a polarity opposite that of the high frequency audio component.

18. The stereophonic audio processing circuitry as defined in claim 17 wherein said summing means comprises an op-amp having a non-inverting input receiving the low frequency audio signal through a first ratio resistor and receiving the B-channel input signal through a second ratio resistor, and having an inverting input receiving the high frequency audio signal said op-amp providing as output the modified A-channel signal.

19. The stereophonic audio processing circuitry as defined in claim 17 wherein said A-channel processor comprises:

a first low pass filter receiving as input said A-channel signal and providing as output a first low frequency audio signal;

a first high pass filter receiving as input said A-channel signal and providing as output a first high frequency audio signal;

a first op-amp having a non-inverting input receiving the first low frequency audio signal through a first ratio resistor and receiving the B-channel input signal through a second ratio resistor, and having an inverting input receiving the first high frequency audio signal, said op-amp providing as output an intermediate modified A-channel signal;

a second low pass filter receiving as input the intermediate modified A-channel signal and providing as output a second low frequency audio signal;

a second high pass filter receiving as input the partially modified A-channel signal and providing as output a second high frequency audio signal;

a second op-amp having a non-inverting input receiving the second low frequency audio signal, and having an inverting input receiving the second high frequency audio signal through a third ratio resistor and receiving the B-channel input signal through a fourth ratio resistors said op-amp providing as output the modified A-channel signal.

20. The stereophonic audio processing circuitry as defined in claim 19 wherein said processing circuitry further comprises an input processor providing a symmetrically modified stereo signal pair from which a symmetrically modified A-channel signal is applied as input to said A-channel processor, said input processor comprising:

first cross-coupling circuitry introducing symmetrical high frequency channel-to-channel cross-coupling of additive polarity and predetermined amount in the symmetrically modified A-channel signal pair;

a second cross-coupling circuitry introducing symmetrical broadband channel-to-channel cross-coupling of subtractive polarity and adjustable amount in the symmetrically modified A-channel signal pair; and adjustment means for adjusting magnitude of broadband cross-coupling.

21. A method of processing an input stereo signal pair, consisting of an A-channel input signal and a B-channel input signal, to derive a processed stereo signal pair for producing via stereo loudspeakers a modified acoustic field for ambience and image enhancement at an asymmetrical listening location, comprising the audio signal processing steps of:

(a) additively cross-coupling a predetermined channel-to-channel signal portion symmetrically over a predetermined high frequency audio range;

(b) subtractively cross-coupling a predetermined channel-to-channel signal portion symmetrically over a full frequency audio range;

(c) providing a first modified stereo signal comprising a first modified A-channel signal and a first modified B-channel signal which have been processed according to steps (a) and (b);

(d) low-pass and high-pass filtering the first modified A-channel signal to derive a low frequency audio signal and derive a high frequency audio signal which is inverted in polarity relative to the low frequency audio signal; and (e) summing the low frequency audio signal, the high frequency audio signal and the B-channel input signal in predetermined proportions and polarity so as to provide as output a second modified A-channel signal wherein a cross-coupled B-channel high frequency signal component is made to be opposite in polarity to a high frequency A-channel signal component.

22. The signal processing method as defined in claim 21 further comprising the step of:

(f) processing the first modified B-channel signal through a non-inverting variable gain audio amplifier thus deriving a second modified B-channel signal.

23. The signal processing method as defined in claim 22 further comprising the step of:

(g) selecting by audio signal switching means a signal pair, constituting the processed stereo signal pair, chosen from the following group: (1) the input stereo signal pair, (2) a first modified stereo signal pair consisting of the first modified A-channel and B-channel signals, and (3) a second modified stereo signal pair consisting of the second modified A-channel signal and the second modified B-channel signal;

whereby selection of signal pair (2) introduces a modification of the input stereo signal comprising symmetrical additive cross-coupling in a high frequency range for increasing perceived stereo imaging, and symmetrical subtractive cross-coupling over a full frequency range for enhancing ambience effect, and selection of signal pair (3) introduces a further stereo signal modification comprising frequency-selective polarity inversion and a predetermined proportion of asymmetrical cross-coupling for enhancing ambience effect as perceived at asymmetric and off-speaker-axis listening locations.

24. The signal processing method as defined in claim 23 comprising the further step of:

(h) applying the stereo signal pair selected in step (g) as input to a pair of audio power amplifiers driving stereo loudspeakers.

* * * * *